US008241090B2

(12) United States Patent
Michael

(10) Patent No.: US 8,241,090 B2
(45) Date of Patent: Aug. 14, 2012

(54) BRA STRAP HOLDER

(76) Inventor: Jannet Rosello Michael, Reading, PA (US)

( * ) Notice: Subject to any disclaimer, the term of this patent is extended or adjusted under 35 U.S.C. 154(b) by 0 days.

(21) Appl. No.: 12/657,966

(22) Filed: Feb. 1, 2010

(65) Prior Publication Data

US 2010/0173564 A1 Jul. 8, 2010

(51) Int. Cl.
*A41C 3/00* (2006.01)

(52) U.S. Cl. ..... 450/86; 24/302; 24/163 R; 2/326; 2/327

(58) Field of Classification Search ..... 2/338, 336, 2/310–312, 323–329; 450/86, 88, 1; 24/72.7, 24/198–200, 102 A, 102 B, 301, 300
See application file for complete search history.

(56) References Cited

U.S. PATENT DOCUMENTS

| | | | | | |
|---|---|---|---|---|---|
| 820,710 | A * | 5/1906 | Ford | 24/184 |
| 2,095,340 | A * | 10/1937 | Meyer | 24/198 |
| 2,613,420 | A * | 10/1952 | Brown | 24/200 |
| 2,901,801 | A * | 9/1959 | Girodet | 24/200 |
| 3,075,268 | A * | 1/1963 | Schwartz | 24/200 |
| 3,077,650 | A * | 2/1963 | Horne | 24/200 |
| 3,161,931 | A * | 12/1964 | Zif | 24/200 |
| 3,177,541 | A * | 4/1965 | Derrickson | 24/200 |
| 6,059,634 | A * | 5/2000 | Fildan | 450/86 |
| 6,163,937 | A * | 12/2000 | McKinnis et al. | 24/302 |
| 6,179,687 | B1 * | 1/2001 | Lee et al. | 450/88 |
| 7,278,900 | B1 * | 10/2007 | Ostaseski | 450/86 |

* cited by examiner

*Primary Examiner* — Gloria Hale
(74) *Attorney, Agent, or Firm* — Lori J. Sandman; Sandman Law Office, PC.

(57) ABSTRACT

The bra strap holder is used to secure the bra straps in the back of the bra from sliding down the shoulders. It is comprised of a clear TPU (Thermoplastic Polyurethane) strap welded to unique three prong flexible plastic ends which attach to the bra strap.

9 Claims, 3 Drawing Sheets

BRA STRAP HOLDER

BACKGROUND OF THE INVENTION

The present invention relates generally to clothing and garments. More specifically, it relates to an improved design for supporting garments, particularly bras (brassieres), across the back to eliminate slippage of straps off the shoulder without exerting constrictive force between the garment's straps.

Many garments are made with straps that go from the front up over the shoulder and join a laterally connecting portion that fastens around the back. Bras are generally configured this way. The straps support breast weight by distributing pressure across the shoulders. Because of the bra's fabric texture, cut, or a particular person's body shape, these straps may slip off of the optimal support position on the shoulder and down the arm. This decreases the support efficiency of the straps and may result in discomfort or annoyance for the wearer, who has to continually replace the strap to the support position.

Although bra strap retainers have been disclosed in the past, the prior art only addresses lateral adjustment of the straps themselves or relies on pressure that constrains the straps from slipping off the shoulders of the wearer by pulling the straps together.

In order to keep the straps of a bra or other strapped garment in place, the present invention attaches to the straps of the garment and holds them in the optimal support position. Each strap is held in position such that it will remain on the shoulder and not slip. The position is maintained not by pulling the straps together, but by restraining them from outward movement. The present invention connects the straps to each other, and holds each strap in place. Because it is made of clear, moderately flexible material, it is virtually invisible and comfortable for the wearer.

The brassiere shoulder strap securement apparatus includes a thermoplastic polyurethane (tpu) strip with a first and second opposite end. Each end of the tpu strip has a flexible plastic holder attached thereto for securing a brassiere shoulder strap there through. The flexible plastic holders have a smooth quasi-circular shaped outer perimeter edge and a central pronged portion. The central pronged portion has a longer middle prong and two shorter angled prongs adjacent the perimeter wherein each one of the shoulder straps are intertwined there through and secured thereto to thereby prevent said shoulder straps from sliding off of a wearer's shoulders. Each of said holders includes an inward tpu strap attachment side portion that includes an opening there through so that each of said opposite ends of the tpu strip is looped there through and about and inward side portion and then permanently attached to the outward surface of the strip by thermoplastic welding. The quasi-circular shape has a smooth perimeter edge in the shape of an octagon with all eight corners being smooth as seen in the figures. The holder is structured with sooth, flat surfaces so that they lie flat on the skin surface of wearer in use and so that the three prongs extend outwardly away from the tpu strip surface so that the shoulder straps on the brassiere are easily intertwined through the prongs and securely held therein.

BRIEF SUMMARY OF THE INVENTION

The present invention is designed for use with bras or other garments that have straps running up and over the shoulders of the wearer. Referring to FIGS. 1, 2, and 3, the present invention utilizes a pair of flexible plastic holders 10 having a distinct configuration including three prongs 20, 30, and 40.

These three-pronged plastic holders (hereinafter "holders") 10 are connected by a thermoplastic polyurethane (TPU) strip 50. The bra's straps 60 are passed between the prongs of the holders as shown in FIGS. 2 and 3.

Referring to FIG. 1, the present invention incorporates a clear, slightly flexible TPU strip 50. This strip 50 is passed through an opening 55, then wrapped around and attached to the holders by thermoplastic welding.

In a typical configuration, the bra holder is positioned above the lateral bra strap 70 to optimize support and balance the straps. In the embodiment as drawn in FIGS. 2 and 3, the TPU strip 50 passes across the back perpendicular to the bra's straps 60.

DETAILED DESCRIPTION OF THE INVENTION

Figure 1:
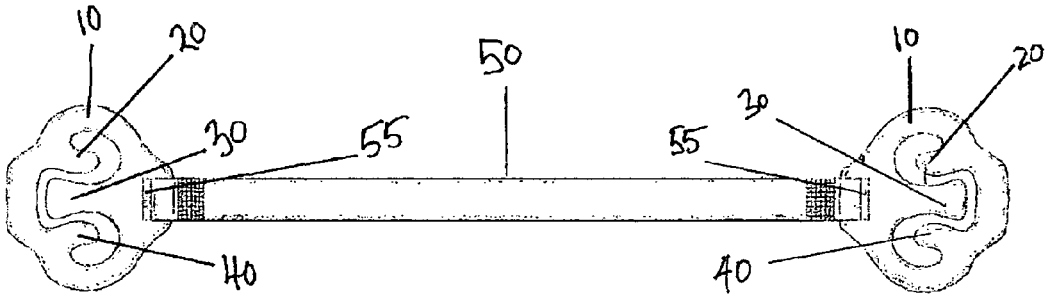
FIG. 1 illustrates a top view, looking down on the invention.

FIG. 1 shows the top view of the invention, and illustrates the parts of the bra strap holder. It incorporates a clear thermoplastic polyurethane (TPU) strip 50 attached by thermoplastic welding to unique three prong flexible plastic holders 10 that attach to the wearer's bra's straps 60 or other strapped garment.

Figure 2:
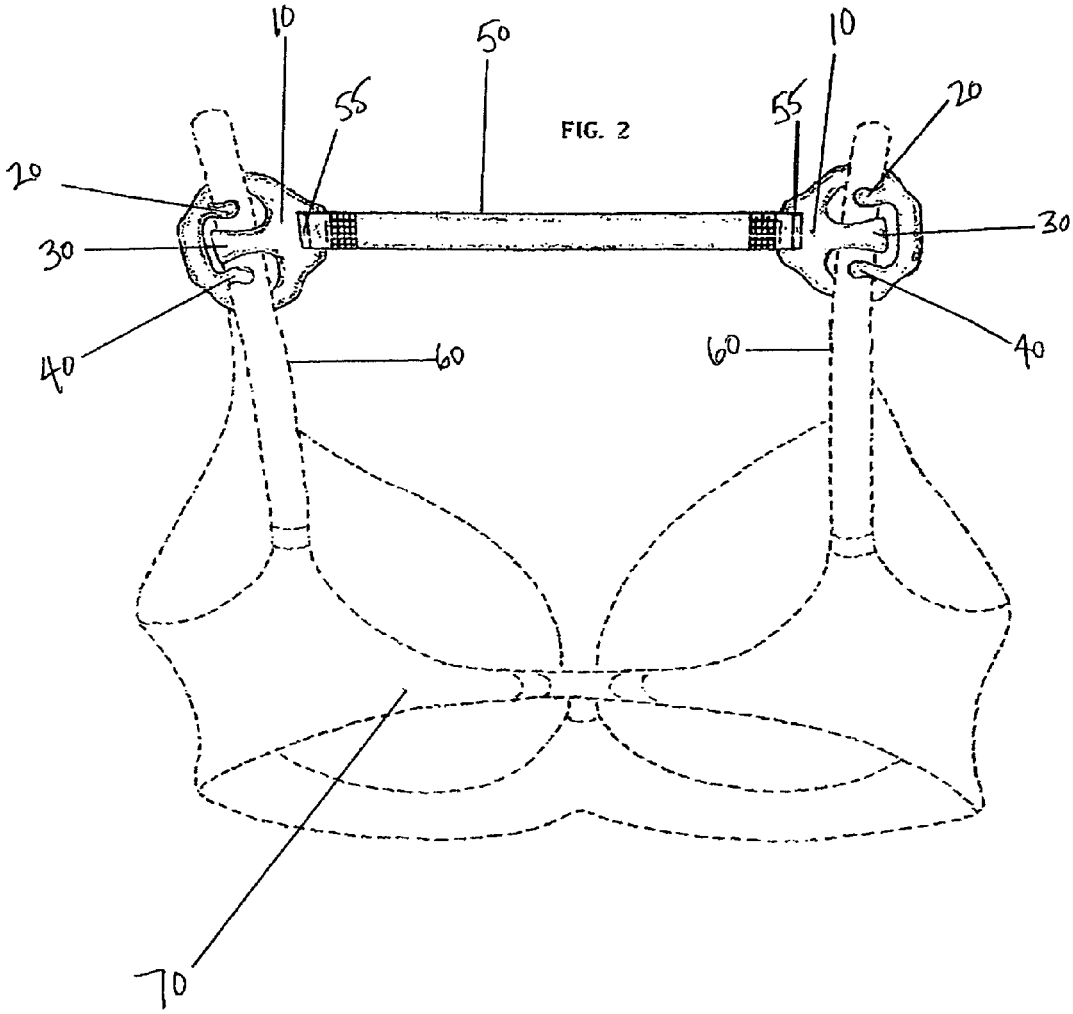
FIG. 2 is a three dimensional view of the back of a bra with the invention placed between the bra's straps 60.

To attach the bra's strap 60 to the bra strap holder 10, the invention is placed between the bra's straps 60 as shown in FIG. 2. The bra's straps 60 are run inside of the top prong 20, around the middle prong 30 and back outside of the prongs below the lower prong 40.

Figure 3:
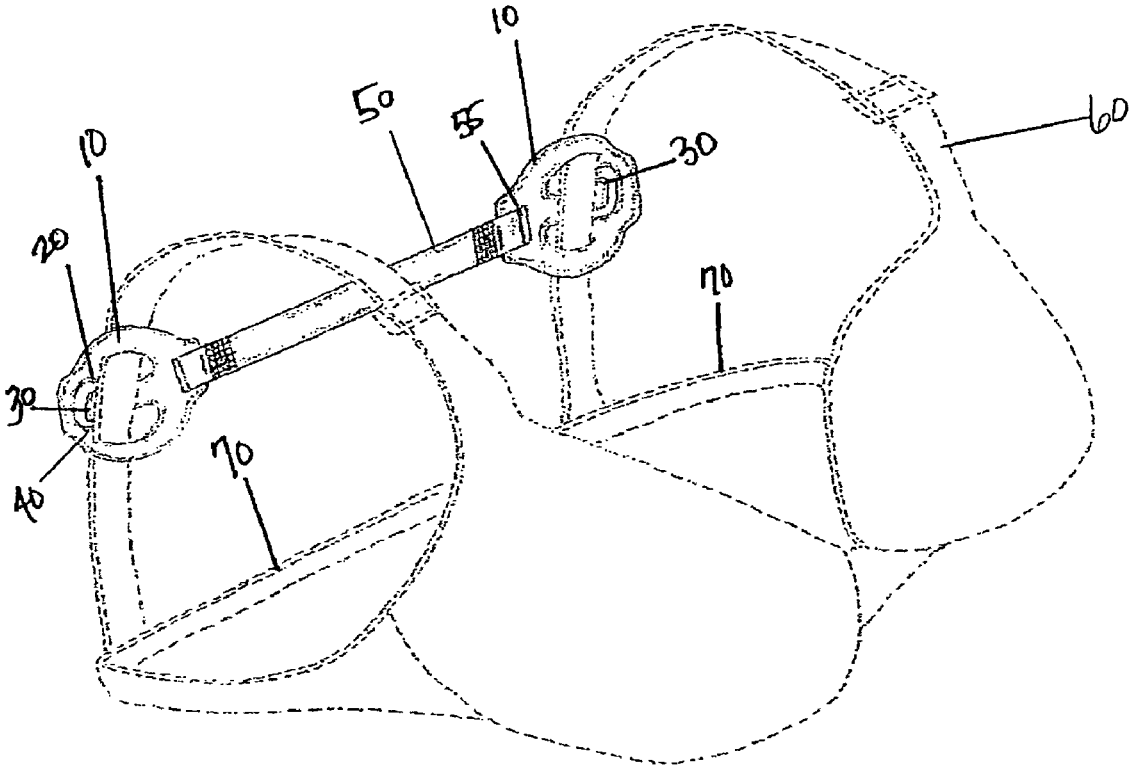
FIG. 3 shows a three dimensional front view of a bra with the invention positioned between the bra's straps 60 which would rest across the wearer's back.

In FIG. 3, the preferred embodiment of the invention can be seen from the front and side of the wearer. The flexible plastic holders 10 are held in their optimal support position, connected by the TPU strip 50. The TPU strip 50, although moderately flexible, is not elastic enough to result in pulling the bra's straps 60 together. Instead, it disallows the bra's straps 60 from falling off the shoulders of the wearer by restricting outward motion. The TPU strip's 50 limited flexibility constricts outward movement; the flexibility it does allow provides for comfort for the wearer. It can be manufactured to a plurality of lengths (i.e., small, medium, large, etc.) that would ensure only restriction of outward motion of the bra's straps 60 without inward pull.

The TPU strip 50 is attached to the flexible plastic holders 10 by passing the TPU material through an opening 55 in the flexible plastic holder 10 and wrapping it back on itself and attaching by thermal welding process.

The flexible plastic holders 10 maintain their vertical position on the bra's straps 60 because of their unique configuration. The bra's straps 60 attach by being positioned between three prongs. The two outside prongs (20 and 40) are positioned on either side of a middle, longer prong 30. The two outer prongs face generally inward towards the wearer's spine, while the center prong 30 extends outward towards the outside of the back. These outside prongs are also curved slightly outward. The result of these inward facing, curved prong end portions is that on the inside top, the upper prong 20 curves upward, holding the invention from sliding upwards on the bra strap vertically, while the lower curved prong on the bottom 40 of the bra strap prevents the invention from slipping downwards on the bra's strap 60.

The invention claimed is:

1. A brassiere shoulder strap securement apparatus comprising:

a thermoplastic polyurethane (tpu) strip having a first end and a second opposite end;

each end of said tpu strip having a flexible plastic holder attached thereto for securing a brassiere shoulder strap there through;

each of said flexible plastic holders having a smooth quasi-circular shaped outer perimeter edge and a central pronged portion;

said central portion including a three-pronged configuration with a longer middle prong and two shorter angled prongs adjacent said perimeter wherein each one of said shoulder straps are intertwined there through and secured thereto to thereby prevent said shoulder straps from sliding off of a wearer's shoulders;

each of said holders includes an inward tpu strap attachment side portion that includes an opening there through so that each of said opposite ends of said tpu strip is looped there through and about said inward side portion and then permanently attached to an outward surface of said strip by thermoplastic welding; and wherein when said apparatus is worn on a wearer the tpu strip holds said brassiere shoulder straps inwardly thereby preventing them from sliding off a wearer's shoulders.

2. The apparatus as claimed in claim 1 wherein said smooth edged quasi-circular shaped holder has a smooth perimeter edge in the shape of an octagon with all eight corners being smooth.

3. The apparatus of claim 1 wherein said holder is structured with a smooth, flat surface to thereby lie flat on the skin surface of a wearer and said three pronged central prongs extend outwardly away from an outer tpu strip surface and the skin surface of said wearer so that said shoulder straps are easily intertwined through said prongs within said holder to form a secure securement and to thereby hold said shoulder straps on said wearer's shoulders.

4. The method of making a brassiere shoulder strap securement apparatus comprising:

providing a thermoplastic polyurethane (tpu) strip of material having a first end and a second opposite end;

providing a flexible plastic brassiere shoulder strap holder having a smooth quasi-circular shaped outer perimeter edge and a central pronged portion;

said central portion including a three-pronged configuration with a longer middle prong and two shorter angled prongs adjacent said perimeter and structured so that wherein each one of said brassiere shoulder straps are intertwined there through and secured thereto in use to thereby prevent said shoulder straps from sliding off of a wearer's shoulders;

each of said plastic holders further includes an inward tpu strap attachment side portion that includes an opening there through; each end of said tpu strip is looped there through and about said inward side portion and then permanently attached to an outward surface of said tpu strip by thermoplastic welding; and wherein when said apparatus is worn on a wearer, the tpu strip holds said brassiere shoulder straps inwardly thereby preventing them from sliding off a wearer's shoulders.

5. The method of making a brassiere shoulder strap securement apparatus as claimed in claim 4 and further comprising:

said holder perimeter edge being formed in a smooth edged octagonal shape.

6. The method of making a brassiere shoulder strap securement apparatus as claimed in claim 4 and further comprising:

said holder as being structured with a smooth, flat surface to thereby lie flat on the skin surface of a wearer and wherein said three pronged central prongs extend outwardly away from an outer tpu strip surface and the skin surface of said wearer so that said shoulder straps are easily intertwined through said prongs within said holder to form a secure securement and to thereby hold said shoulder straps on said wearer's shoulders.

7. A method of securing a wearer's brassiere shoulder straps on a wearer's shoulders with a brassiere shoulder strap securement apparatus as claimed in claim 1 to prevent said brassiere shoulder straps from falling off of a wearer's shoulders comprising:

providing a brassiere shoulder strap securement apparatus including a thermoplastic polyurethane (tpu) strip having a first end and a second opposite end;

and with each end of said tpu strip having a flexible plastic holder attached thereto for securing a brassiere shoulder strap there through;

intertwining each of said brassiere shoulder straps through their respective plastic holder and wherein each of said flexible plastic holders has a smooth quasi-circular shaped outer perimeter edge and a central pronged portion;

with said central portion including a three-pronged configuration with a longer middle prong and two shorter angled prongs adjacent said perimeter and wherein each one of said shoulder straps are intertwined there through and secured thereto to thereby prevent said shoulder straps from sliding off of a wearer's shoulders;

each of said holders includes an inward tpu strap attachment side portion that includes an opening there through so that each of said opposite ends of said tpu strip is looped there through and about said inward side portion and then permanently attached to an outward surface of said strip by thermoplastic welding; and wherein when said apparatus is worn on a wearer the tpu strip holds said brassiere shoulder straps inwardly thereby preventing them from sliding off a wearer's shoulders.

8. The method of securing a wearer's brassiere shoulder straps on a wearer's shoulders as claimed in claim 7 and further comprising:

said smooth edged quasi-circular shaped holder has a smooth perimeter edge in the shape of an octagon with all eight corners being smooth.

9. The method of securing a wearer's brassiere shoulder straps on a wearer's shoulders as claimed in claim 7 and further comprising:

wherein said holder is structured with a smooth, flat surface to thereby lie flat on the skin surface of a wearer and said three pronged central prongs extend outwardly away from an outer tpu strip surface and the skin surface of said wearer so that said shoulder straps are easily intertwined through said prongs within said holder to form a secure securement and to thereby hold said shoulder straps on said wearer's shoulders.

* * * * *